US007780466B1

(12) United States Patent
Wu

(10) Patent No.: US 7,780,466 B1
(45) Date of Patent: Aug. 24, 2010

(54) CABLE ASSEMBLY WITH LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/454,999

(22) Filed: May 26, 2009

(51) Int. Cl.
*H01R 13/627* (2006.01)

(52) U.S. Cl. ..... 439/354; 439/358

(58) Field of Classification Search ..... 439/354, 439/353, 358
See application file for complete search history.

(56) References Cited

U.S. PATENT DOCUMENTS 6,565,383 B1 * 5/2003 Wu ..... 439/567
6,655,979 B1 * 12/2003 Lee ..... 439/357
6,860,749 B1 3/2005 Wu
6,860,750 B1 3/2005 Wu
6,890,205 B1 * 5/2005 Wu ..... 439/358
6,976,865 B2 * 12/2005 Wu ..... 439/352
7,083,460 B2 * 8/2006 Wu ..... 439/357

* cited by examiner

*Primary Examiner*—Hien Vu
(74) *Attorney, Agent, or Firm*—Wei Te Chung; Andrew C. Cheng; Ming Chieh Chang

(57) ABSTRACT

A cable connector assembly (1) includes an insulative housing (10), a number of contacts (12) disposed in the housing, a cover (15) molded onto the housing and a locking member (16) assembled to the housing and the cover. The locking member defines about a front end thereof a retention portion (160) for securing the locking member on the housing, an actuating portion (162) about a rear end thereof, and a locking portion (161) extending rearwards across the retention portion and connecting to the actuating portion.

10 Claims, 9 Drawing Sheets

CABLE ASSEMBLY WITH LOCKING MEMBER

BACKGROUND OF THE INVENTION

1. Field of the Invention

The present invention relates to an electrical connector assembly, and particularly to a cable assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively compact in configuration. It is desirable for the Serial ATA connector to have latch mechanism for providing a reliable mechanical and electrical connection with a complementary connector. U.S. Pat. Nos. 6,565,383, 6,585,536, 6,860,749 and 6,860,750, having the same inventor and the same assignee with the present invention, each disclose a Serial ATA connector equipped with a locking member for locking with a complementary connector. Understandably, the locking members shown in above-mentioned patents adopt different approaches to achieve the same object.

Hence, a connector assembly with a new locking member structure is still needed.

BRIEF SUMMARY OF THE INVENTION

Accordingly, it is an object of the present invention is to provide a cable assembly having an improved locking member for engaging/disengaging the cable assembly with/from a complementary connector more conveniently.

To achieve afore-mentioned object, a cable connector assembly in accordance with the present invention comprises an insulative housing, a plurality of contacts disposed in the housing, a cable including a plurality of wires electrically and mechanically connecting with corresponding contacts, and a locking member assembled to the housing. The locking member is accessible from outside for locking/unlocking the connector with/from a complementary connector. The locking member defines at a front end thereof a retention portion for securing the locking member on the housing, an actuating portion at a rear end thereof, and a locking portion extending rearwards across the retention portion and connecting to the actuating portion.

Other objects, advantages and novel features of the invention will become more apparent from the following detailed description of the present embodiment when taken in conjunction with the accompanying drawings.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE PREFERRED EMBODIMENT

Figure 1:
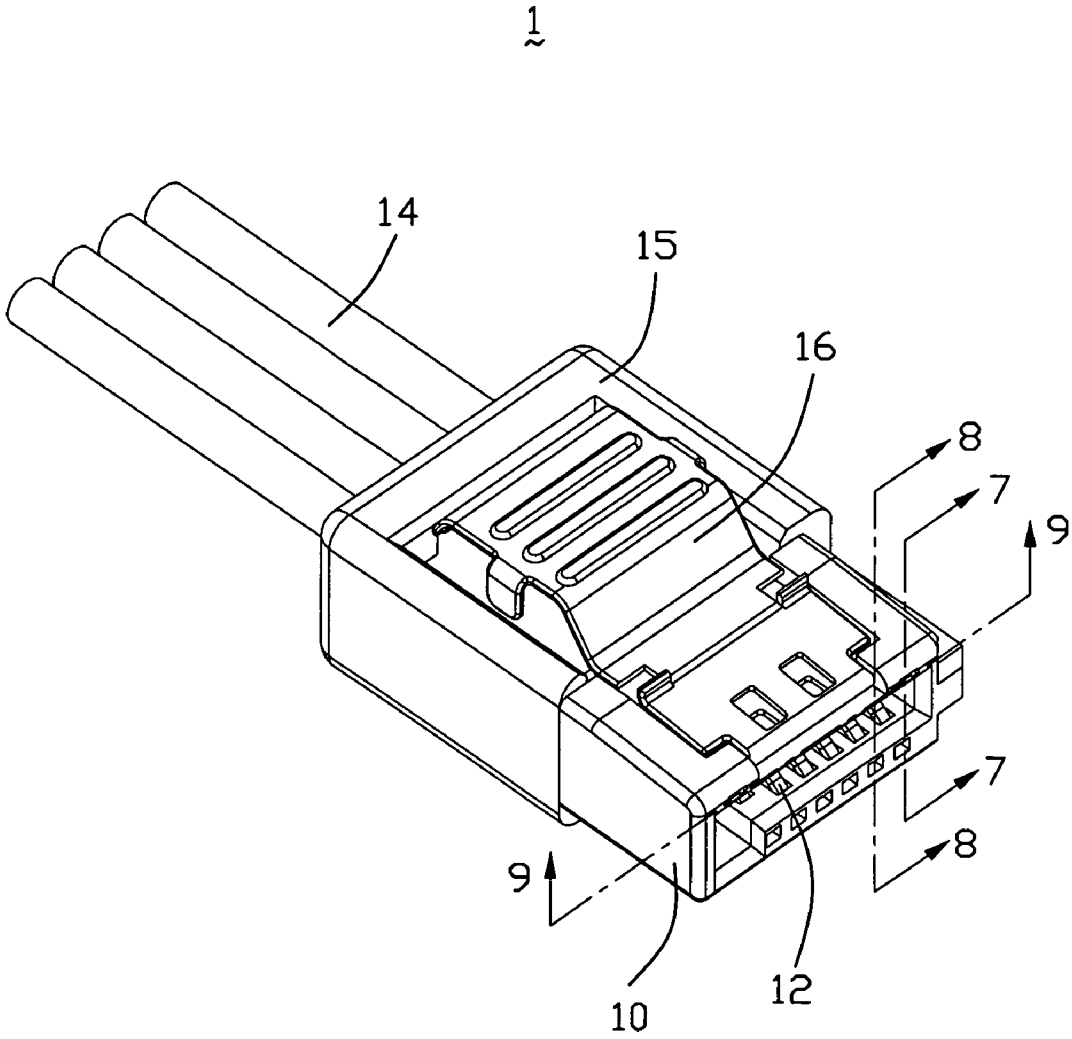
FIG. 1 is a perspective view of a cable assembly in accordance with the present invention.
Figure 2:
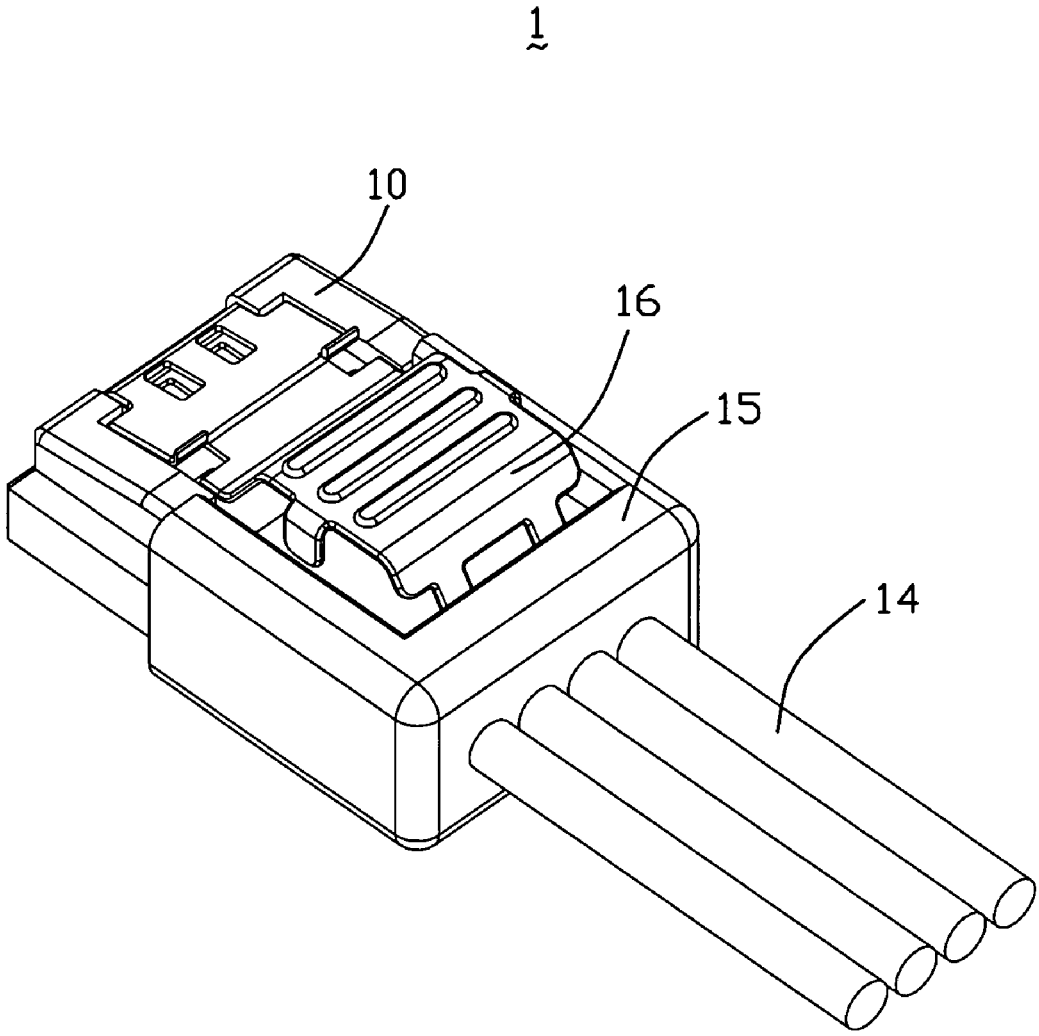
FIG. 2 is a view similar to FIG. 1, but taken from a different aspect.

Reference will now be made to the drawing figures to describe the present invention in detail.

Referring to FIGS. 1 to 4, a cable end electrical connector assembly 1 in accordance with the present invention comprises an insulative housing 10, a plurality of contacts 12, a spacer 13, a cable 14, a cover 15 and a locking member 16.

Figure 3:
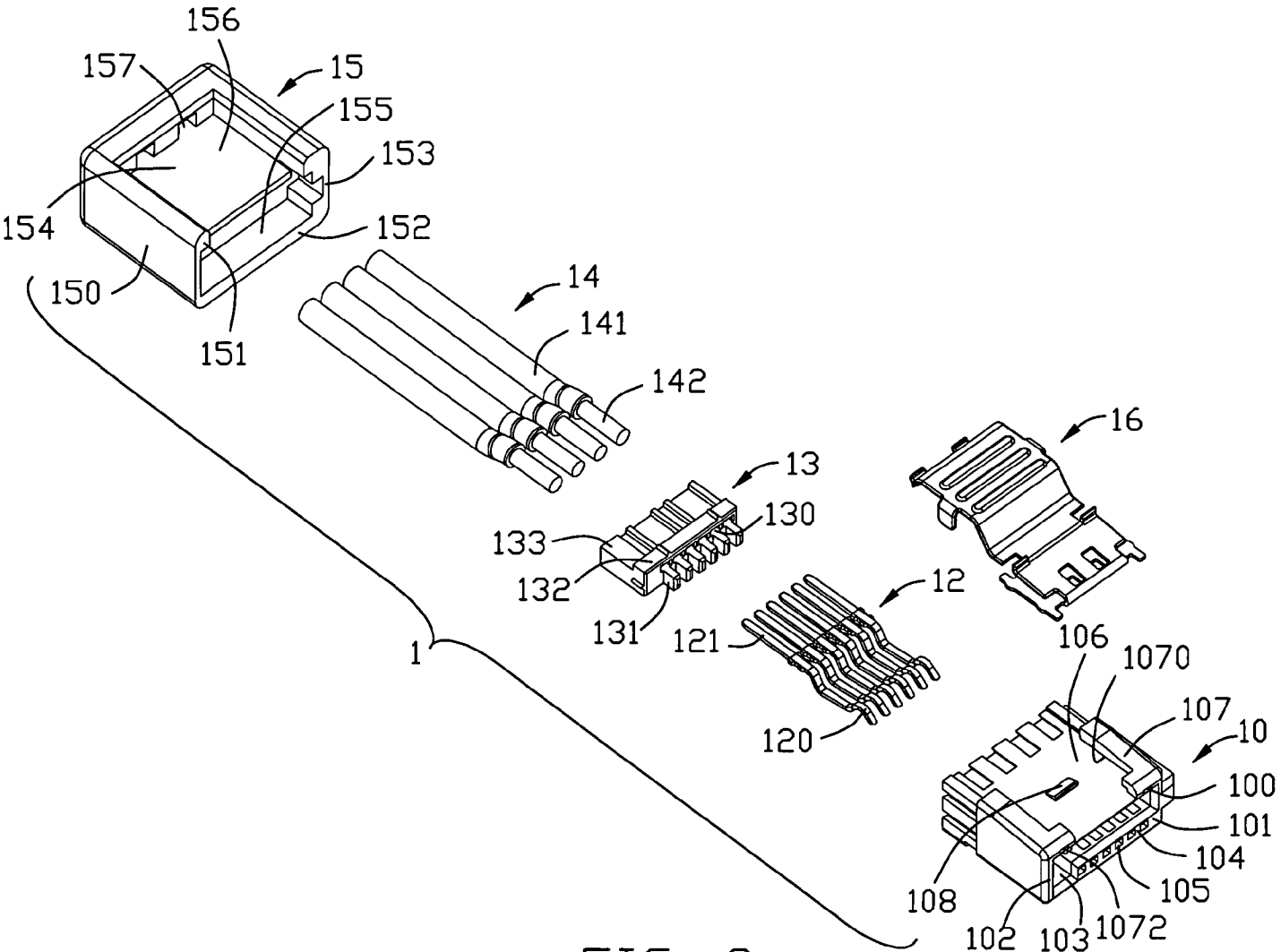
FIG. 3 is an exploded, perspective view of the cable assembly shown in FIG. 1.
Figure 4:
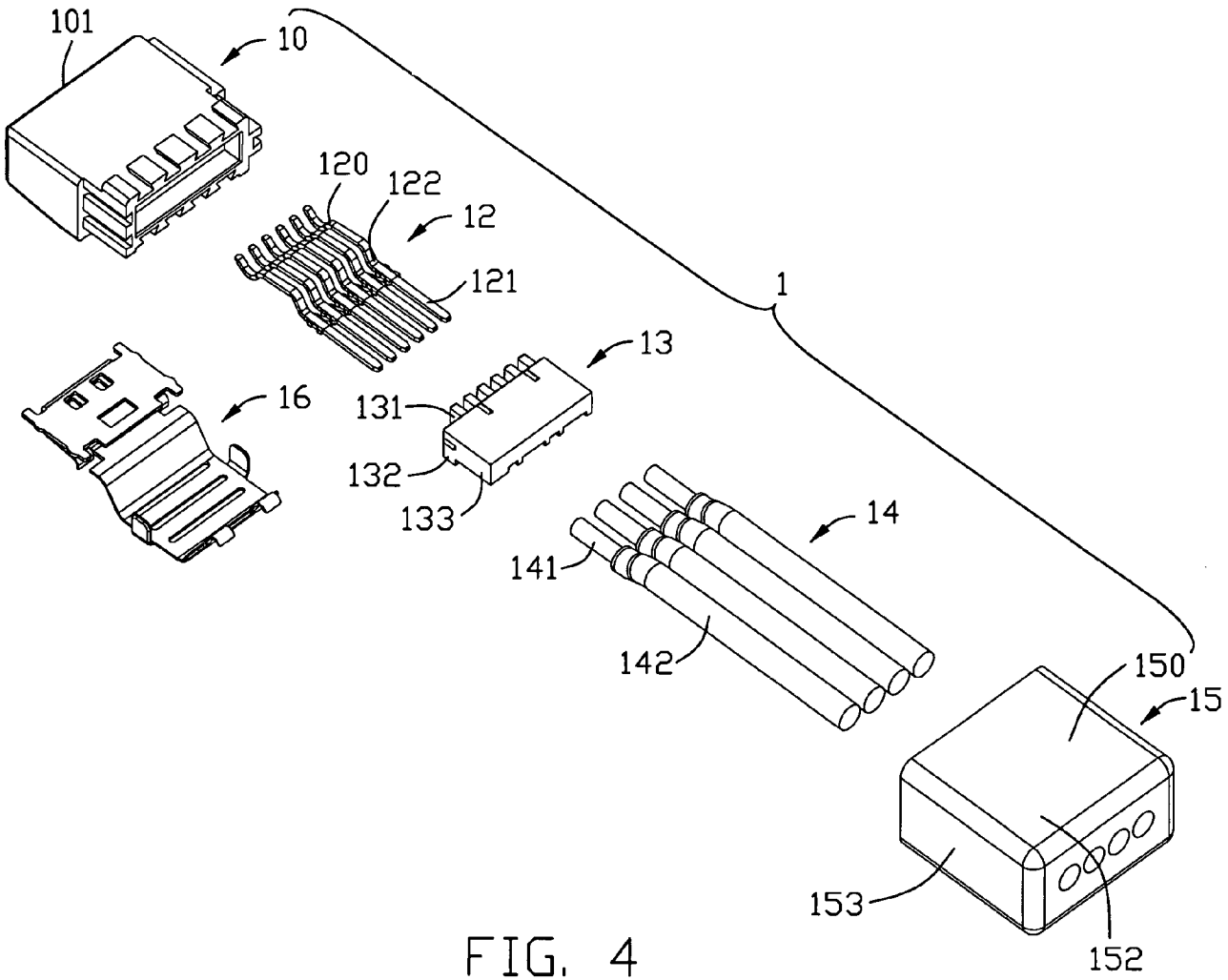
FIG. 4 is an exploded, perspective view of the cable assembly shown in FIG. 2.

Referring to details in FIGS. 3-4, the insulative housing 10 comprises an upper wall 100, a lower wall 101 opposite to the upper wall 100, and a pair of sidewalls 102 connecting with the upper wall 100 and the lower wall 101. A receiving space 103 with an L-shaped interface is defined between the upper and the lower walls 100, 101. A tongue portion 104 is formed on the lower wall 101 and protrudes into the receiving space 103. The tongue portion 104 defines a plurality of passageways 105 extending therethrough for receiving corresponding contacts 12. A pair of L-shaped blocks 107 extends upwardly and respectively from opposite sides of the upper wall 100 and a depression 106 is defined between the blocks 107 and the upper wall 100. A groove 1070 is defined between each block 107 and a bottom surface of the depression 106. Understandably, the bottom surface of the depression 106 can also be regarded as a top surface of the housing 10 in this embodiment. A pair of slits 1072 extends rearwards from a front face of the upper wall 100 into the block 107 and communicates with the grooves 1070, respectively. A protrusion 108 is formed on the top surface of the housing 10 within the depression 106. A cavity is formed in a rear face of the housing 10 and in communication with the corresponding passageways 105, respectively.

Each contact 12 includes a contacting portion 120, a tail portion 121 and a connection portion 122 connecting the contacting portion 120 and the tail portion. The contacts 12 are received in the passageways 105 of the insulative housing 10 with the tail portions 121 thereof extending rearwardly beyond a rear face of the insulative housing 10. The spacer 13 is mounted to a rear end of the insulative housing 10 and defines a plurality of through holes 130 for allowing the tail portions 121 of the contacts 12 extending therethrough. The spacer 13 includes a middle base 132 received in the cavity 109, and a plurality of protrusions 131 located in front of the base 132 and received in the corresponding passageways 105, respectively, and a mounting plate 133 located behind the base 131 for seating the contact tail portion 121 thereon. Under this structure, the spacer 13 can prevent plastic from entering into the passageways 105 of the insulative housing 10 during the molding of the cover 15. Alternately, the contacts 12 and the spacer 13 can be integrally formed before mounting to the insulative housing 10, if desired. The cable 14 is configured with a plurality of wires 141 each including an inner conductor 142 electrically and mechanically connecting with corresponding tail portions 121 of the contacts 120. Obviously, the spacer 13 is optional in according to the present embodiment, which provides a space for connecting the cable 14 and the contacts 12.

The cover 15 is over-molded with and encloses the rear end of the insulative housing 10 and the cable 14. The cover 15 comprises a rectangular body portion 150. The body portion 150 comprises an upper plate 151, a lower plate 152 opposite to the upper plate 151, and a pair of side plates 153 connecting with the upper plate 151, the lower plate 152. The body portion 150 includes a partition 154 extending between the pair of side plates 153. A receiving cavity 155 is surrounded by the upper, the lower plates 151, 152 and the side plates 153 for receiving the rear end of the insulative housing 10 and the spacer 13. A depression or a recess 156 is defined between the partition 154 and the pair of side plates 153 and a pair of passages 157 are defined at a rear end of the body portion 150, which communicates with the depression 156.

Figure 5:
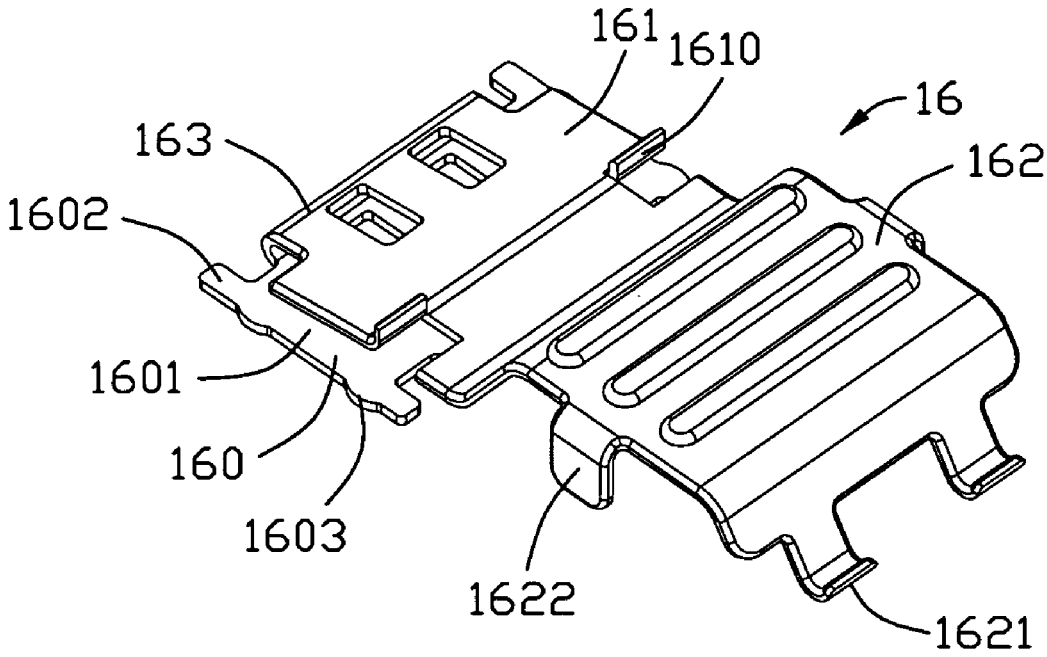
FIG. 5 is an enlarged view of a locking member of the cable assembly.
Figure 6:
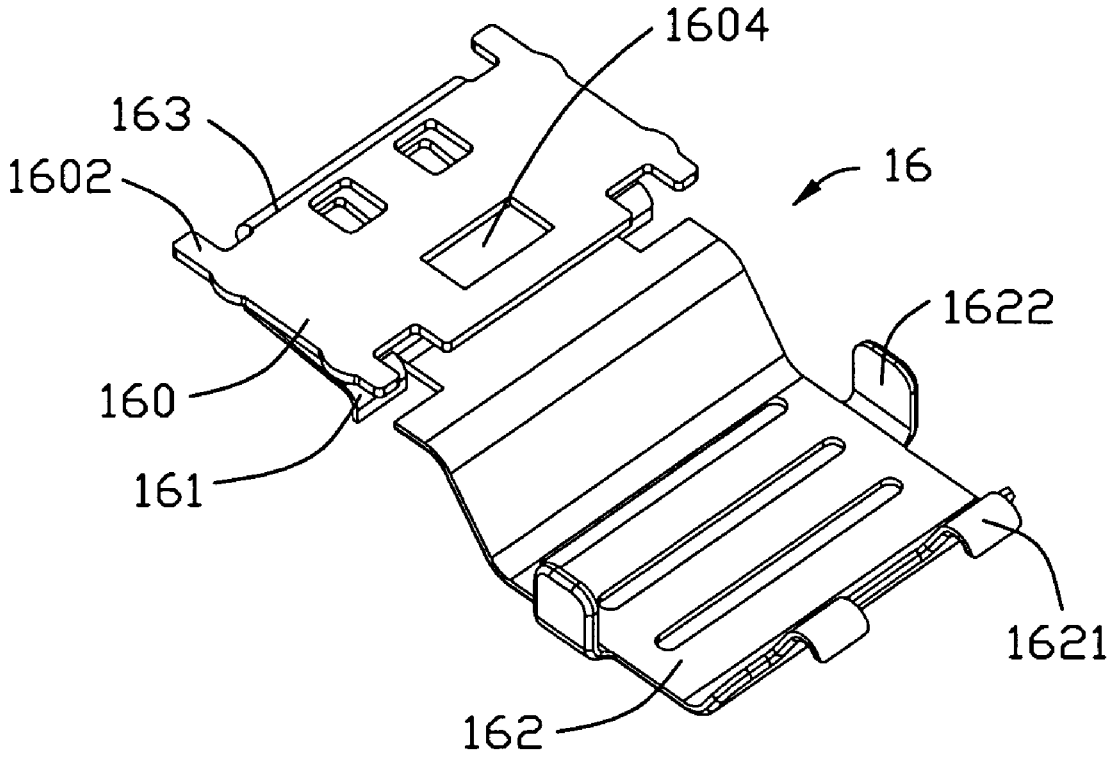
FIG. 6 is a view similar to FIG. 5, but taken from a different aspect.

Turn to FIGS. 5 and 6, the locking member 16 is stamped and formed from a metallic sheet and is configured with a retention portion 160 at a front end thereof for securing the locking member on the housing 10, a locking portion 161 for engaging with a complementary connector or a plug (not shown), and an actuating portion 162 at a rear end thereof. In the preferred embodiment, the retention portion 160 is formed with a substantially rectangular, planar plate 1601 and a pair of retention tabs 1602 extending into the housing 10 and received in the slits 1072. A plurality of projections or barbs 1603 project from opposite side edges of the planar plate 1601 for interference fitting in the grooves 1070 of the housing 10. The locking portion 161 is connected to the retention portion 160 by a curved portion 163. The curved portion 163 is a resilience-adjusting portion which can provide the flexibility when the locking portion 161 subjects to an external force. The curved, resilient portion 163 extends between the pair of the retention tabs 1602 transversely and connects the forward edges of the retention portion 160 and the locking portion 161. Clearly, the retention portion 160 is folded down from and extends below the locking portion 161. The locking portion 161 includes a pair of latch tabs 1610 projecting upwards therefrom for locking with corresponding portion of the complementary plug. The actuating portion 162 provides a pair of retention claws 1621 extending rearwards into the passages 157. A pair of stoppers 1622 are formed at opposite edges of the actuating portion 162 and extend downwards.

Figure 7:
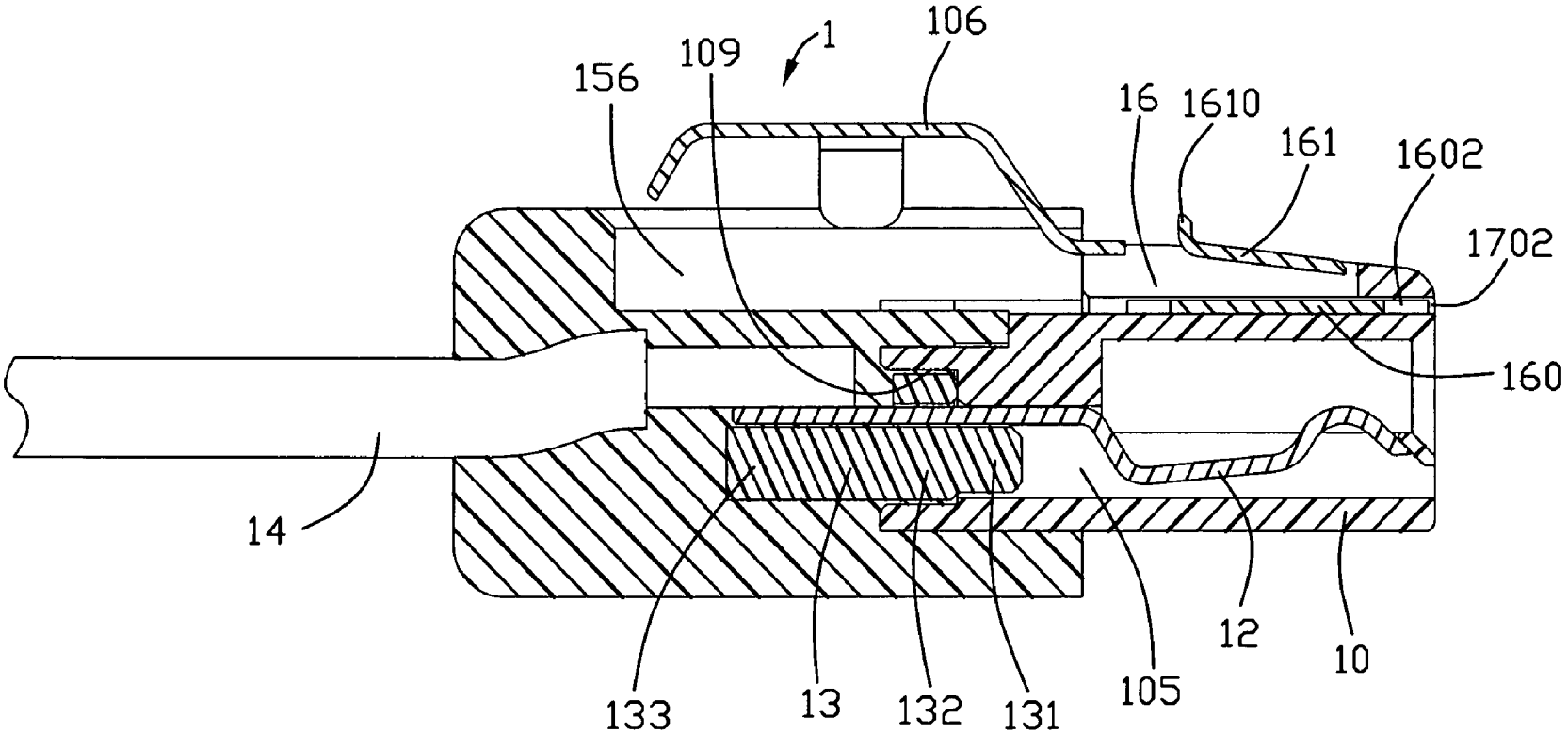
FIG. 7 is a cross-sectional view taken along line 7-7 of FIG. 1.
Figure 8:
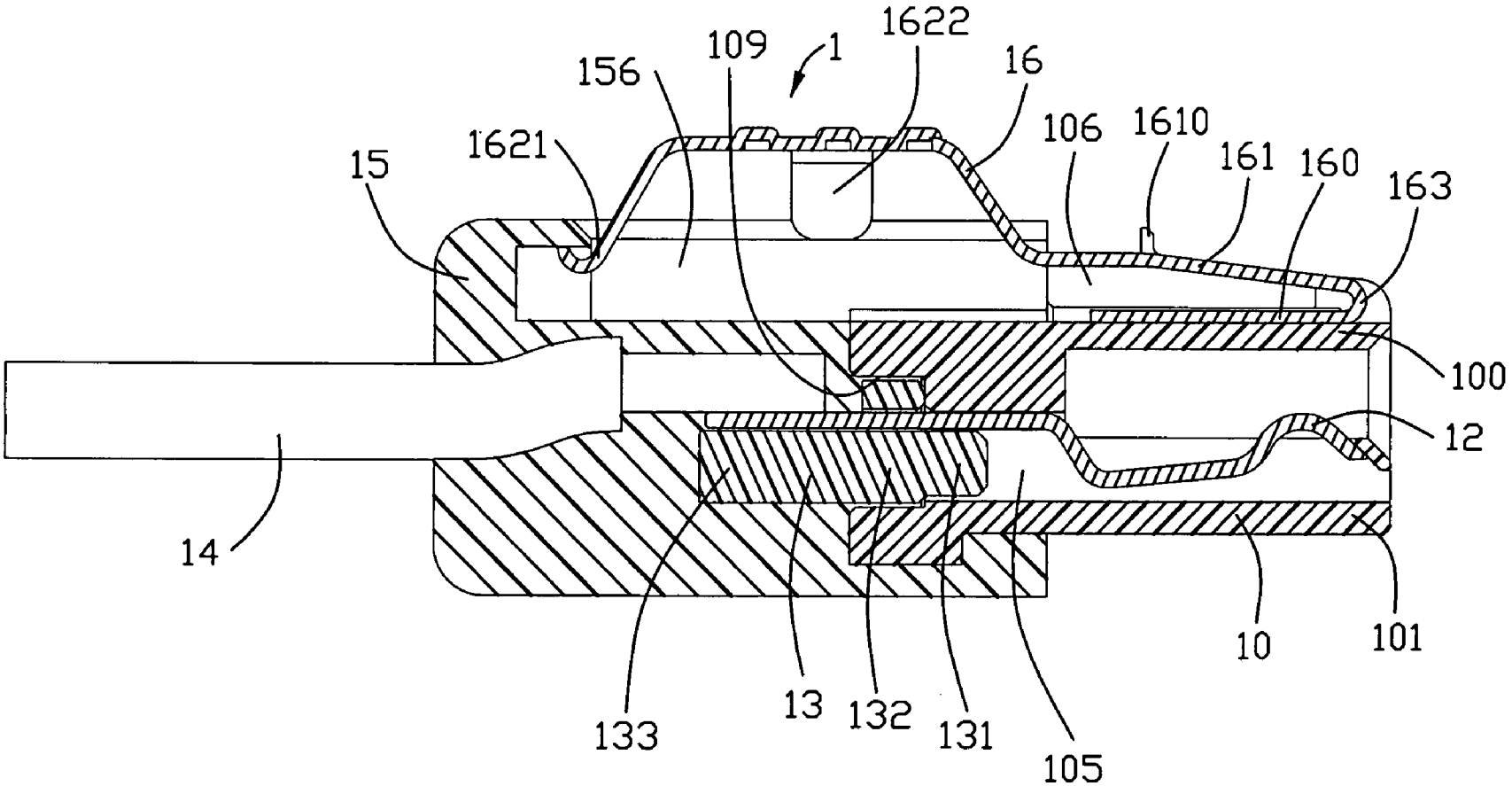
FIG. 8 is a cross-sectional view taken along line 8-8 of FIG. 1.
Figure 9:
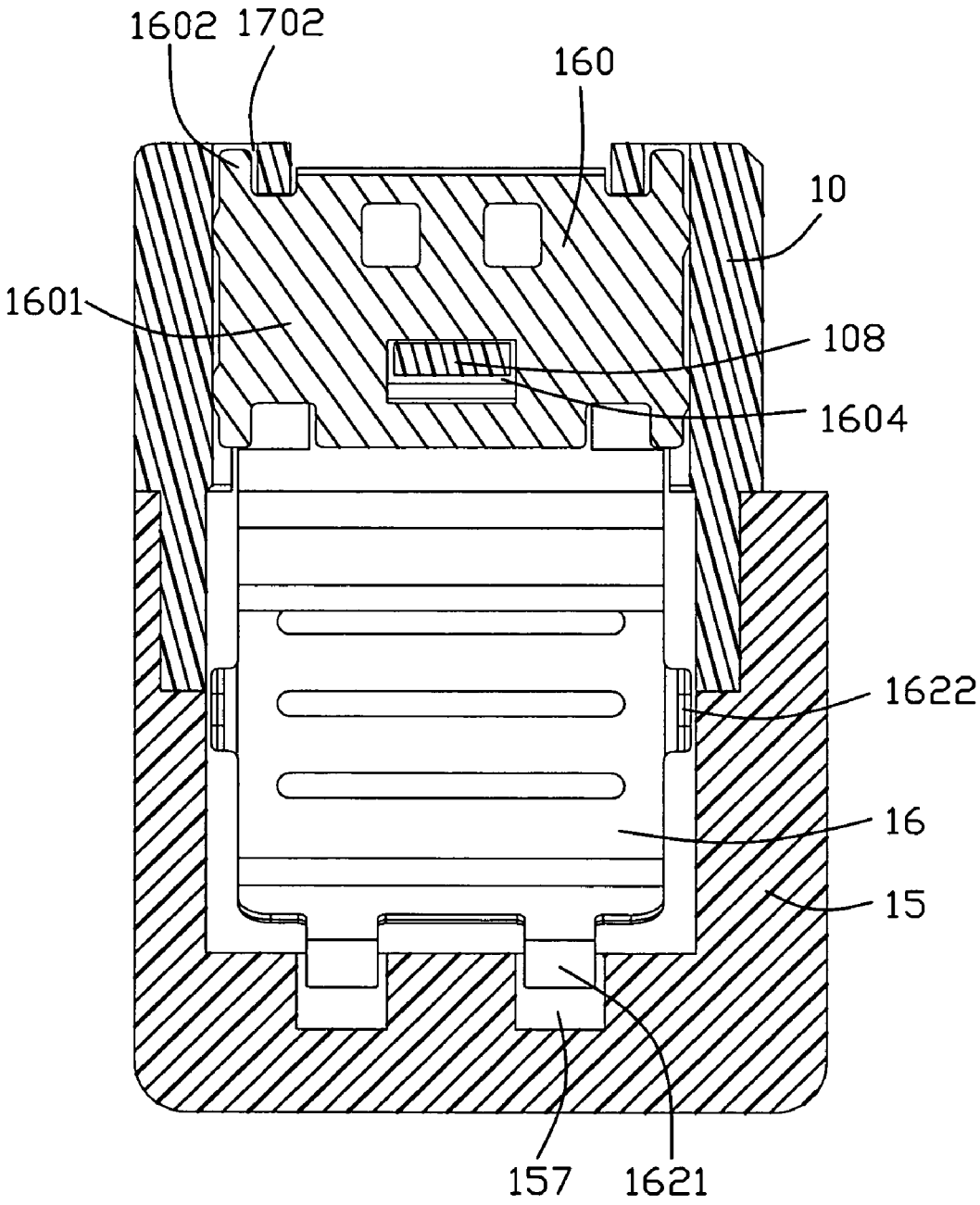
FIG. 9 is a cross-sectional view taken along line 9-9 of FIG. 1.

Referring to FIGS. 7-9 in conjunction with FIGS. 1-2 and 3-4, in assembling, a plurality of conductors 142 of the wires 141 of the cable 14 are terminated, for example by soldering to the tail portions 121 of the contacts 12, which are extending through the spacer 13. The cover 15 is over-molded with the rear end of the insulative housing 10 and the front end of the cable 14. The cavity 155 of the cover 15 communicates with the receiving space 103 and the recess 156 communicates with the depression 106 of the insulative housing 10. In the preferred embodiment, a top surface of the partition 154 of the cover 15 is coplanar with the top face of the housing 10. The locking member is assembled to the housing 10 and the cover 15 with the retention tabs 1602 extending into the slits 1072, the retention claws 1621 received in the passages 157, and with the barbs or the protrusions 1603 interference fitting within the grooves 1701. In such a manner, the planar plate 1601 abuts against the top face of the housing 10. See details in FIGS. 7-9, the passage 157 provides a limited space for the retention claw 1621 capable of moving up-to-down. The retention claw 1621 abuts against a upper face of the passage 157 before the connector 1 mates with the complementary plug. The protrusion 108 of the housing is retained in the recess 1604 of the locking member 16.

When the cable assembly 1 is to be mated with the complementary connector, a downward pressing force is firstly exerted on the actuating portion 162 of the locking member 16. The locking portion 161 displaces towards the housing 10 together with the actuating portion 162 until the latch tabs 1610 engaging with corresponding portion of the inserted, complementary connector. When the cable assembly 1 is to be disengaged from the complementary connector, a contrary operating procedure is applied. Obviously, the curved, resilient portion 163 of the locking member 16 provides enough elastic force for the locking portion 162 and the connection between the mated two complementary connectors are secured. Moreover, the structure of the locking member 16 in accordance with the present invention is simple and thereby easy to manufacture, therefore, the cost is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing;

a plurality of contacts disposed in the housing;

a cable including a plurality of wires electrically and mechanically terminated with corresponding contacts; and a locking member assembled to the housing and exposed to outside for locking/unlocking the connector from a complementary connector, said locking member defining at a front end thereof a retention portion for securing the locking member on the housing, an actuating portion at a rear end thereof, and a locking portion extending rearwards across the retention portion and connecting to the actuating portion;

wherein the retention portion defines a planar plate abutting against a top face of the housing and a pair of retention tabs at a front end thereof for engaging with the housing;

wherein the locking member comprises a curved resilient portion connecting the locking portion and the retention portion and extending widthwise between the pair of retention tabs;

wherein the retention portion has a plurality of barbs interference fit in the housing;

wherein the locking member comprises at least one latch tab projecting upwardly from the locking portion for engaging with a complementary connector;

wherein the housing provides a protrusion formed on the top face thereof, and wherein the retention portion defines a slot between the pair of retention tabs for receiving the protrusion of the housing; and wherein the locking portion is backwardly folded from a front edge of the retention portion via the curved resilient portion, and essentially located aligned with and located above said retention portion in a vertical direction.

2. The cable connector assembly as claimed in claim 1, wherein at least on retention claw is formed on a rear edge of the actuating portion and wherein the housing defines a slot receiving the at least one retention claw to hold the rear end of the locking member in position.

3. The cable connector assembly as claimed in claim 2, wherein at least one stopper is formed on the actuating portion and located between the locking portion and the at least one retention claw in a longitudinal direction.

4. The cable connector assembly as claimed in claim 2, wherein the at least one retention claw is restrictively moveable within the slot of the housing.

5. The cable connector assembly as claimed in claim 2, wherein the housing comprises an insulative base and a cover attached to the insulative base, and wherein the insulative base and the cover together defines a depression for receiving the locking member.

6. The cable connector assembly as claimed in claim 5, wherein the housing defines at least one L-shaped recess in a front face thereof from which the complementary connector can be inserted.

7. The electrical connector assembly as claimed in claim 6, further comprising a spacer on which the wires of the cable and the contacts are connected.

8. The electrical connector assembly as claimed in claim 7, wherein the housing defines a plurality of passageways to receive the corresponding contacts, respectively, and a cavity in a rear face thereof in communication with the passageways, respectively, and said spacer includes a middle base received in the cavity, a plurality of through holes defined in the base, through which tail portions of the contacts extend, respectively, a plurality of protrusions located in front of the base and received in the corresponding passageways, respectively, and a mounting plate located behind the base where said tail portions of the contacts are seated.

9. A cable connector comprising:

an insulative housing defining a plurality of passageways extending along a front-to-back direction;

a cavity defined in a rear face of the housing and in communication with the corresponding passageways, respectively;

a plurality of contacts received in the corresponding passageways, respectively, each of contacts defining opposite contact portion and tail portion;

a plurality of wires connected to the tail portions of the corresponding contacts, respectively;

an overmold covering a rear portion of the housing and front portion of the wires via an injecting molding;

a spacer including a middle base received in the cavity, a plurality of through holes defined in the base, through which the tail portions of the contacts extend, respectively, a plurality of protrusions located in front of the base and received in the corresponding passageways, respectively, and a mounting plate located behind the base where said tail portions of the contacts are seated; and a locking member assembled to said housing, and defining an immovable retention portion with a middle recess therein, and a moveable locking portion with an associated moveable actuation portion;

wherein the locking portion is essentially located on the housing and has at least one latch tab projecting upwardly from the moveable lock portion, and the actuation portion is essentially located on the overmold;

wherein the immovable retention portion defines a planar plate abutting against a top face of the housing and a pair of retention tabs at a front end thereof for engaging with the housing;

wherein the locking member comprises a curved resilient portion connecting the moveable locking portion and the immovable retention portion and extending widthwise between the pair of retention tabs; and wherein the moveable locking portion is backwardly folded from a front edge of the immovable retention portion via the curved resilient portion, and essentially located aligned with and located above said retention portion in a vertical direction.

10. The cable connector as claimed in claim 9, wherein said base of the spacer seals the cavity and the protrusions of the spacer seal the corresponding passageways, respectively.

* * * * *